US009932725B1

(12) United States Patent
Figueira

(10) Patent No.: US 9,932,725 B1
(45) Date of Patent: Apr. 3, 2018

(54) PREFABRICATED PLUMBING CONNECTION FOR A SINK

(71) Applicant: Francisco Figueira, Brooklyn, NY (US)

(72) Inventor: Francisco Figueira, Brooklyn, NY (US)

( * ) Notice: Subject to any disclaimer, the term of this patent is extended or adjusted under 35 U.S.C. 154(b) by 186 days.

(21) Appl. No.: 15/000,482

(22) Filed: Jan. 19, 2016

(51) Int. Cl.
*E03C 1/02* (2006.01)
*E03C 1/12* (2006.01)

(52) U.S. Cl.
CPC ..... *E03C 1/021* (2013.01); *E03C 1/12* (2013.01)

(58) Field of Classification Search
CPC ..... E03C 1/021; E03C 1/12
USPC ..... 4/670; 137/360
See application file for complete search history.

(56) References Cited

U.S. PATENT DOCUMENTS 2,832,080 A 4/1958 Blessing
3,221,454 A * 12/1965 Togni ..... E03C 1/01 4/670
3,766,574 A 10/1973 Smid
5,261,444 A * 11/1993 Childers ..... E03C 1/021 137/360
D531,285 S 10/2006 Williams
7,204,267 B1 * 4/2007 Persico ..... E03C 1/021 137/360
2003/0056826 A1 3/2003 Thomas
2008/0172953 A1 7/2008 Piorkowski
2015/0026946 A1 1/2015 Mordehay

* cited by examiner

*Primary Examiner* — Tuan N Nguyen
(74) *Attorney, Agent, or Firm* — Kyle A. Fletcher, Esq.

(57) ABSTRACT

The prefabricated plumbing connection for a sink is a pre-plumbed cabinet that is adapted for use with sinks. The prefabricated plumbing connection for a sink is a structure that provides pre-fitted piping that can be used in the installation of a sink. Specifically, the plumbing fittings of the sink are connected directly to the prefabricated plumbing connection for a sink and the house plumbing connections are also connected directly to the prefabricated plumbing connection for a sink. This reduces the number of connections required to install a sink and eliminates the need of the cutting and fitting of pipes. The prefabricated plumbing connection for a sink comprises an encasement, a drain pipe, a hot water feed, and a cold water feed.

16 Claims, 4 Drawing Sheets

PREFABRICATED PLUMBING CONNECTION FOR A SINK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field fluid handling technologies more specifically, a pre-plumbed cabinet that is adapted for use with a sink.

SUMMARY OF INVENTION

The prefabricated plumbing connection for a sink is a pre-plumbed cabinet that is adapted for use with sinks. The prefabricated plumbing connection for a sink is a structure that provides pre-fitted piping that can be used in the installation of a sink. Specifically, the plumbing fittings of the sink are connected directly to the prefabricated plumbing connection for a sink and the house plumbing connections are also connected directly to the prefabricated plumbing connection for a sink. This reduces the number of connections required to install a sink and eliminates the need of the cutting and fitting of pipes. In the first potential embodiment of the disclosure, the prefabricated plumbing connection for a sink is provisioned as a complete vanity unit that is adapted to directly receive the sink. In a second potential embodiment, the prefabricated plumbing connection for a sink the prefabricated plumbing connection for a sink is contained within a metal box that can be mounted into a commercially available vanity for aesthetic purposes.

These together with additional objects, features and advantages of the prefabricated plumbing connection for a sink will be readily apparent to those of ordinary skill in the art upon reading the following detailed description of the presently preferred, but nonetheless illustrative, embodiments when taken in conjunction with the accompanying drawings.

In this respect, before explaining the current embodiments of the prefabricated plumbing connection for a sink in detail, it is to be understood that the prefabricated plumbing connection for a sink is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the prefabricated plumbing connection for a sink.

It is therefore important that the claims be regarded as including such equivalent construction insofar as they do not depart from the spirit and scope of the prefabricated plumbing connection for a sink. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
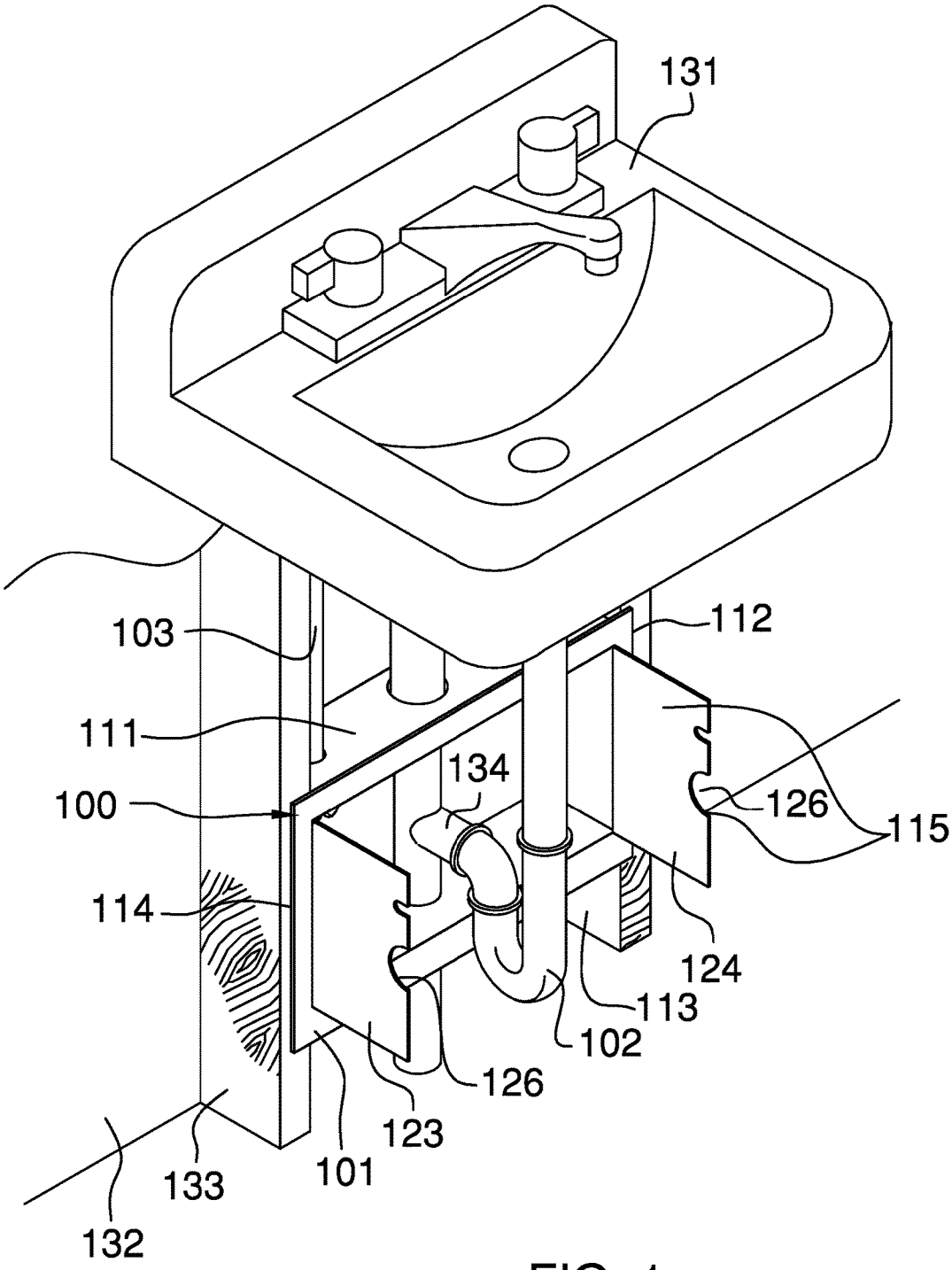
FIG. 1 is a perspective view of an embodiment of the disclosure.
Figure 2:
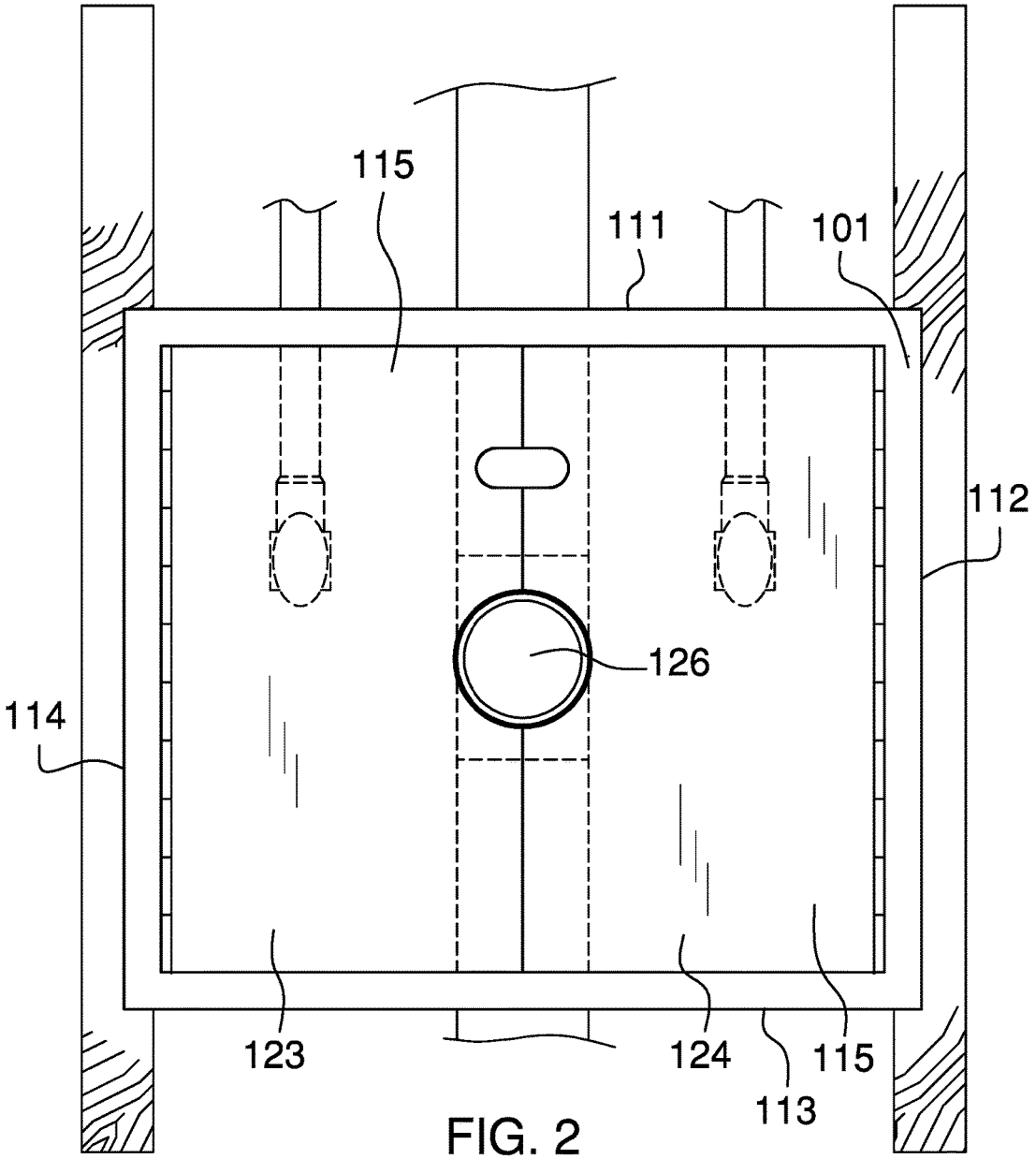
FIG. 2 is a front view of an embodiment of the disclosure.
Figure 3:
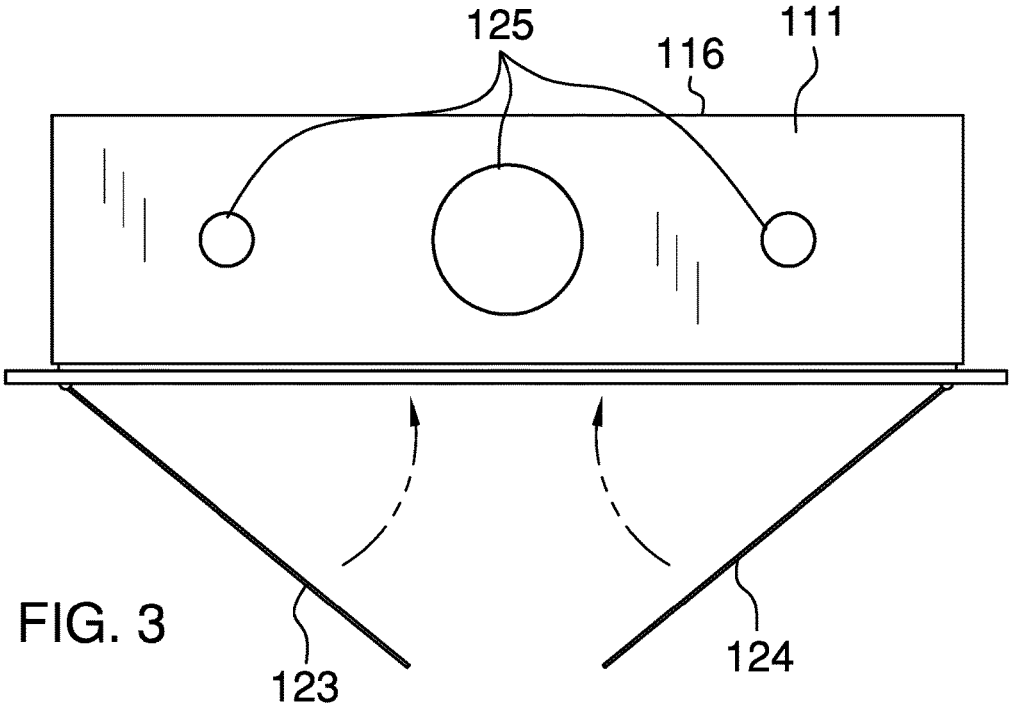
FIG. 3 is a top view of an embodiment of the disclosure.
Figure 4:
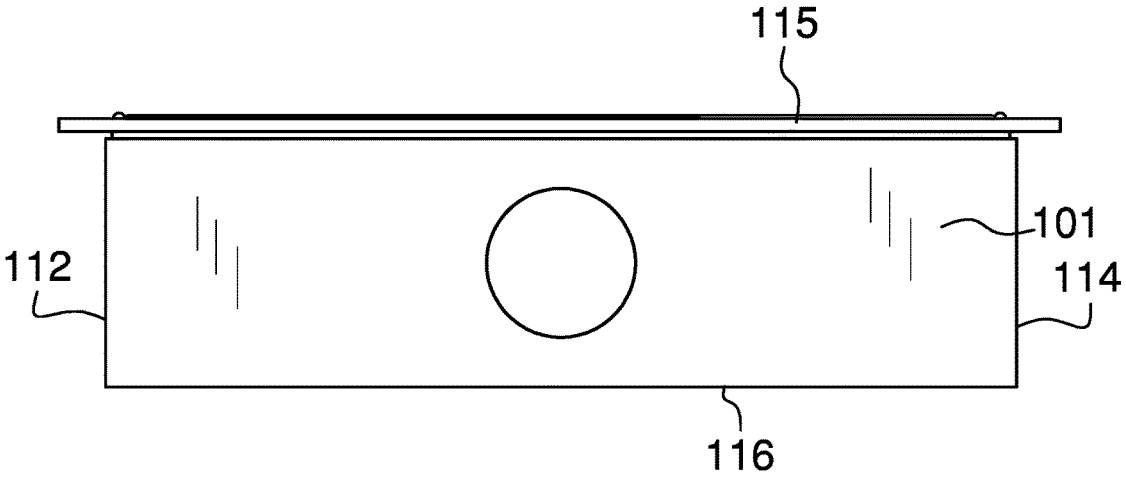
FIG. 4 is a bottom view of an embodiment of the disclosure.
Figure 5:
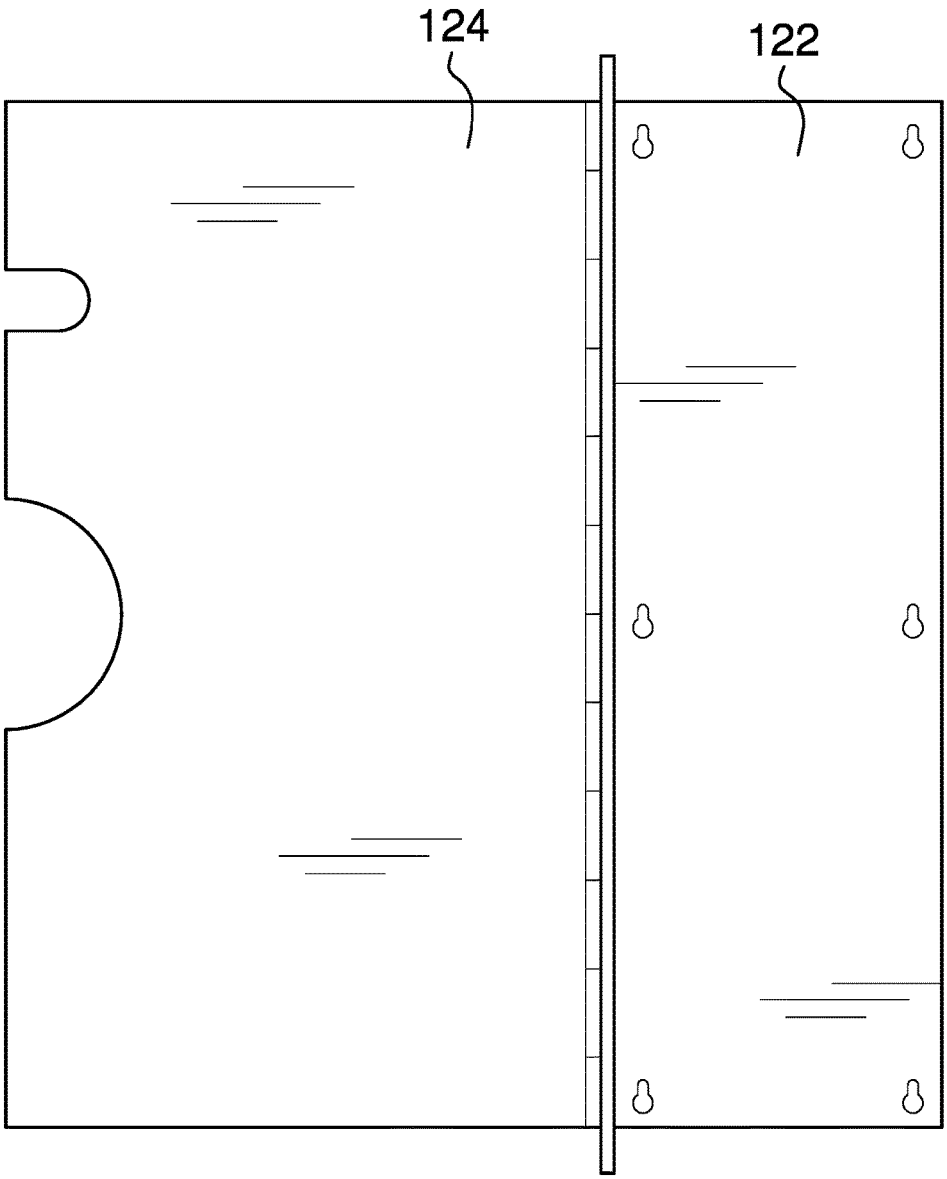
FIG. 5 is a side view of an embodiment of the disclosure.

Detailed reference will now be made to a first potential embodiment of the disclosure, which is illustrated in FIGS. 1 through 5.

The prefabricated plumbing connection for a sink 100 (hereinafter invention) comprises an encasement 101, a drain pipe 102, a hot water feed 103, and a cold water feed 104. The invention 100 is a pre-plumbed cabinet that is adapted for use with sinks 131. The invention 100 is a structure that provides pre-fitted piping that can be used in the installation of a sink 131. Specifically, the plumbing fittings of the sink 131 are connected directly to the invention 100 and the house plumbing connections are also connected directly to the invention 100. This reduces the number of connections required to install a sink 131 and eliminates the need of the cutting and fitting of pipes.

The encasement 101 is a container formed in the shape of a rectangular block. The drain pipe 102, the hot water feed 103, and the cold water feed 104 are mounted in the encasement 101 in a prefabricated fashion. The encasement 101 further comprises, a first side 111, a second side 112, a third side 113, a fourth side 114 a door 115 and a door 115 side, and an open back 116. The open back 116 of the invention 100 is the side of the encasement 101 that is mounted proximal to the wall 132 the invention 100 is mounted to in normal use. The door 115 side is the side of the encasement 101 that is distal from open back 116. The door 115 is a two panel cover that is used to enclose the encasement 101 when access to the plumbing is not required. The door 115 is further defined with a first panel 123 and a second panel 124. The first panel 123 is attached to the fourth side 114 of the encasement 101 using one or more hinges which allows the first panel 123 to rotate away from the encasement 101 using the hinge as a pivot. The second panel 124 is attached to the second side 112 of the encasement 101 using one or more hinges which allows the second panel 124 to rotate away from the encasement 101 using the hinge as a pivot.

A plurality of access ports 125 is formed in the first side of the encasement 101. The purpose of the plurality of access ports 125 is to provide access to hot water feed 103 and the cold water feed 104 for the sink 131. A door hole 126 is formed in the door 115 structure to allow access to the drain pipe 102. When the encasement 101 is viewed from a position such that the viewer is facing the door 115, the remaining sides named clockwise from the first side 111 are the second side 112, the third side 113, and the fourth side 114. A first plurality of mounting holes is formed in the fourth side 114. A second plurality of mounting holes 122 is formed in the second side 112. The invention 100 is installed by using the first plurality of mounting holes and the second plurality of mounting holes 122 to screw the fourth side 114 of the encasement 101 and the second side 112 of the encasement 101, respectively, into the studs of the wall 132, a constructed frame 133, or a sink vanity.

The drain pipe 102 is a commercially available piping that runs from the drain connection 134 of the structure's plumbing, out of the encasement 101 through the door hole 126 and includes a drain trap. The drain pipe 102 is positioned such that when the sink 131 is positioned on the invention 100 the drain pipe 102 is aligned with the drain of the sink 131. The drain pipe 102 is mounted within the encasement 101 using commercially available hardware.

The hot water feed 103 is a commercially available piping that runs from the hot water connection of the structure's plumbing, out of the encasement 101 through the plurality of access ports 125 to connect to the hot water connection of the sink 131. The hot water feed 103 is positioned such that when the sink 131 is positioned on the invention 100 the hot water feed 103, along with the drain pipe 102, is aligned with the hot water connection of the sink 131. The hot water feed 103 is mounted within the encasement 101 using commercially available hardware.

The cold water feed 104 is a commercially available piping that runs from the cold water connection of the structure's plumbing, out of the encasement 101 through the plurality of access ports 125 to connect to the cold water connection of the sink 131. The cold water feed 104 is positioned such that when the sink 131 is positioned on the invention 100 the cold water feed cold 104, along with the drain pipe 102 and the hot water feed 103, are aligned with the cold water connection of the sink 131. The hot water feed 103 is mounted within the encasement 101 using commercially available hardware.

To use the invention 100 the invention 100 is mounted into either the studs of a wall 132, a constructed frame 133, or a sink 131 vanity such that the drain pipe 102, the hot water feed 103, and the cold water feed 104 connect directly into the plumbing system of the structure in which the invention 100 is to be installed. The sink 131 is then mounted directly onto the invention 100 such that the plumbing connections of the sink 131 are connected directly to the invention 100.

The encasement 101 is made from cast iron or polyvinylchloride. The drain pipe 102, hot water feed 103, and cold water feed 104 are commercially available plumbing components.

The following definitions were used in this disclosure:

Hinge: As used in this disclosure, a hinge is a device that permits the turning, rotating, or pivoting of a first object relative to a second object.

Pivot: As used in this disclosure, a pivot is a rod or shaft around which an object rotates or swings.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An appliance comprising an encasement, a drain pipe, a hot water feed, and a cold water feed;

wherein the appliance is a pre-plumbed structure;

wherein the appliance is adapted for use with a sink;

wherein the appliance is a structure that provides pre-fitted piping that can be used in the installation of the sink;

wherein the encasement further comprises; a first side, a second side, a third side, a fourth side, a door, and an open back;

wherein a door hole is formed in the door.

2. The appliance according to claim 1 wherein the encasement is a container formed in the shape of a rectangular block.

3. The appliance according to claim 2 wherein the drain pipe, the hot water feed, and the cold water feed are mounted in the encasement in a prefabricated fashion.

4. The appliance according to claim 3 wherein the open back is mounted proximal to the wall of the appliance is mounted to in normal use.

5. The appliance according to claim 4 wherein the door is used to enclose the encasement.

6. The appliance according to claim 5 wherein the door further comprises a first panel and a second panel.

7. The appliance according to claim 6 wherein a plurality of access ports are formed in the first side of the encasement.

8. The appliance according to claim 7 wherein a first plurality of mounting holes are formed in the fourth side.

9. The appliance according to claim 8 wherein a second plurality of mounting holes are formed in the second side.

10. The appliance according to claim 9 wherein the appliance is installed by using the first plurality of mounting holes and the second plurality of mounting holes to screw the fourth side of the encasement and the second side of the encasement into a structure selected from the group consisting of the studs of a wall, a constructed frame, or a sink vanity.

11. The appliance according to claim 10 wherein the drain pipe runs from a drain connection, out of the encasement and through the door hole.

12. The appliance according to claim 11 wherein the drain pipe is positioned such that when the sink is positioned on the appliance, the drain pipe is aligned with the drain of the sink.

13. The appliance according to claim 12 wherein the hot water feed runs from a hot water connection and through the plurality of access ports.

14. The appliance according to claim 13 wherein the hot water feed is positioned such that when the sink is positioned on the appliance the hot water feed is aligned with the hot water connection of the sink.

15. The appliance according to claim 14 wherein the cold water feed runs from a cold water connection and through the plurality of access ports.

16. The appliance according to claim 15 wherein the cold water feed is positioned such that when the sink is positioned on the appliance the cold water feed cold is aligned with the cold water connection of the sink.

* * * * *